US008905283B2

(12) United States Patent
Tan

(10) Patent No.: US 8,905,283 B2
(45) Date of Patent: Dec. 9, 2014

(54) ANGLED CORE SLOT DISPENSER AND ADAPTER FOR A BIN

(71) Applicant: Daniel Brian Tan, Harahan, LA (US)

(72) Inventor: Daniel Brian Tan, Harahan, LA (US)

( * ) Notice: Subject to any disclaimer, the term of this patent is extended or adjusted under 35 U.S.C. 154(b) by 1 day.

(21) Appl. No.: 13/717,225

(22) Filed: Dec. 17, 2012

(65) Prior Publication Data

US 2014/0166715 A1 Jun. 19, 2014

Related U.S. Application Data

(63) Continuation of application No. PCT/US2012/022424, filed on Jan. 24, 2012.

(51) Int. Cl.

| | |
|---|---|
| ***B65H 35/10*** | (2006.01) |
| ***A47F 9/04*** | (2006.01) |
| ***A47F 13/08*** | (2006.01) |

(52) U.S. Cl.

CPC ..... *B65H 35/10* (2013.01); *A47F 13/085* (2013.01); *A47F 2009/044* (2013.01)

USPC ..... 225/47; 225/51; 225/77; 225/106

(58) Field of Classification Search

CPC ..... B65H 35/10; B65H 2701/191; B65H 35/0006; A47F 2009/44; B65D 33/02

USPC ..... 225/46, 47, 106, 77, 51, 90, 39; 242/598.5, 598.6; 206/554

See application file for complete search history.

(56) References Cited

U.S. PATENT DOCUMENTS

| | | | |
|---|---|---|---|
| 623,441 | A | 4/1899 | Thompson |
| 3,272,346 | A | 9/1966 | Michaud |
| 3,510,034 | A | 5/1970 | Caskey et al. |
| 4,362,278 | A | 12/1982 | Hopkinson |
| 5,219,424 | A | 6/1993 | Simhaee |
| 5,261,585 | A | 11/1993 | Simhaee |
| 5,433,363 | A | 7/1995 | Simhaee |
| 5,556,019 | A | 9/1996 | Morris |
| 5,558,262 | A | 9/1996 | Simhaee |
| 5,752,666 | A | 5/1998 | Simhaee |
| 5,813,585 | A | 9/1998 | Kannankeril et al. |
| 5,934,535 | A | 8/1999 | Kannankeril et al. |
| 5,934,543 | A | 8/1999 | Koduri |
| 6,199,788 | B1 | 3/2001 | Simhaee |

(Continued)

FOREIGN PATENT DOCUMENTS

CA 2246869 * 3/2000 ..... A47F 9/04

*Primary Examiner* — Laura M Lee

(74) *Attorney, Agent, or Firm* — David A. Belasco; Belasco Jacobs & Townsley, LLP

(57) ABSTRACT

An angled core slot dispenser includes an inclined platform sized and shaped to fit beneath a roll of film bags wound on a hollow central core. A core pin has first and second ends, is sized and shaped to fit slidably within the central core and has at least one notch that extends across one of the ends. First and second guide slots are sized, shaped and located to fit slidably about the ends of the core pin. At least one guide rail is located between outer edges of at least one of the guide slots and is sized and shaped to slidably engage the at least one notch. A bag stream guide, side constraints and a snagging hook are attached to the bag dispenser. The dispenser may be attached to an adapter for a bin mounted to a vertical surface formerly used to hold a single wide bag roll.

26 Claims, 7 Drawing Sheets

(56) References Cited

U.S. PATENT DOCUMENTS

| | | | | |
|---|---|---|---|---|
| 6,230,953 | B1 * | 5/2001 | Simhaee | 225/46 |
| 6,234,431 | B1 | 5/2001 | Simhaee | |
| 6,279,806 | B1 | 8/2001 | Simhaee | |
| 6,488,222 | B1 | 12/2002 | West et al. | |
| 7,424,963 | B2 | 9/2008 | Daniels | |
| 8,251,270 | B2 | 8/2012 | Tseng | |
| 2011/0215128 | A1 | 9/2011 | Greg | |

* cited by examiner

FIG. 4
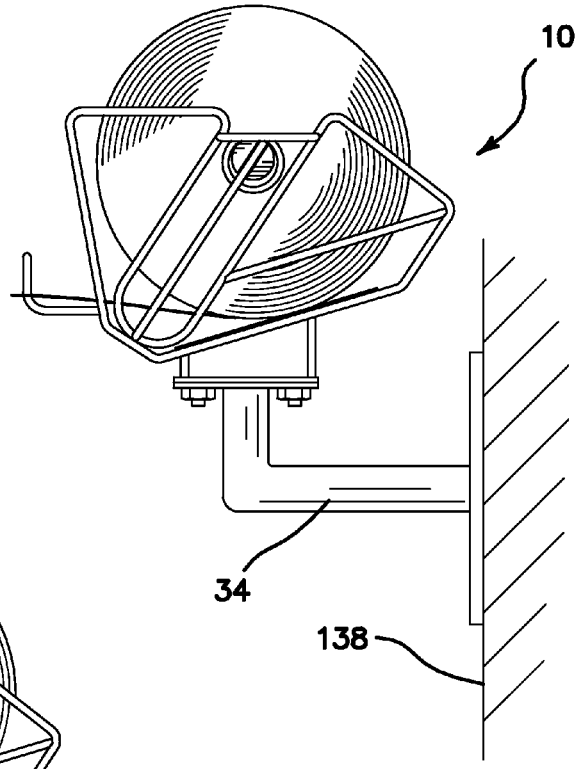
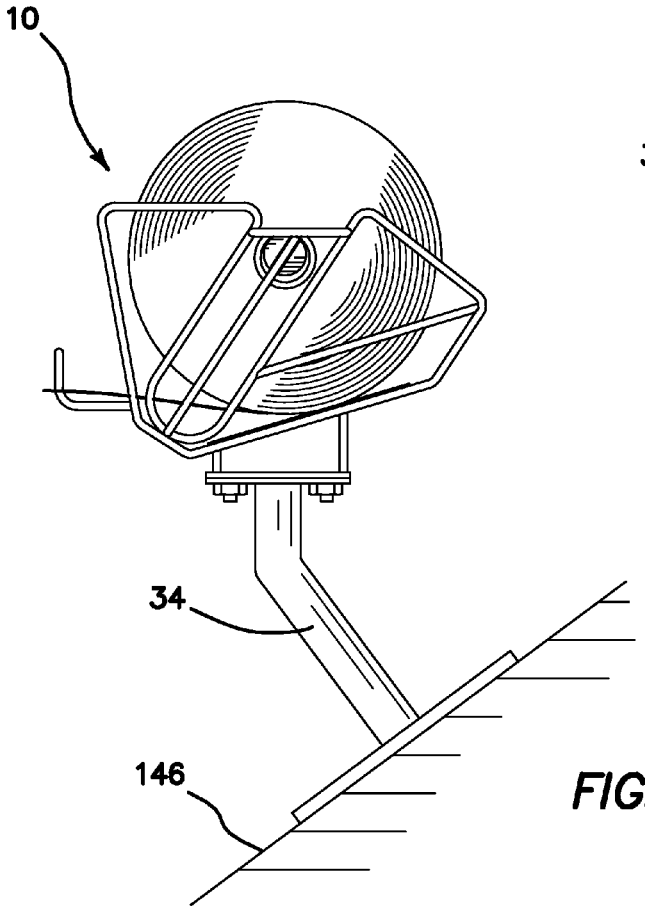
FIG. 5

ANGLED CORE SLOT DISPENSER AND ADAPTER FOR A BIN

RELATED APPLICATION

The instant application is a continuation of PCT Application Serial No. PCT/US2012/022424 filed on Jan. 24, 2012 and claims priority to the filing date thereof.

FIELD OF INVENTION

This invention relates to the field of dispensing systems for plastic and other film bags and more specifically to dispensers for roll mounted bags.

BACKGROUND OF THE INVENTION

As mounting space is usually at a premium in supermarkets and grocery stores, it is desirable to have bag dispensing systems that use a minimum of such space, are adaptable to a variety of dispenser mounting systems and provide means for keeping bags neat and orderly in the store. Roll mounted bag systems, typically used for fresh produce, can help with limited space problems when they are designed to use folded bags. These relatively large bags are folded two to four times along vertical or horizontal axes and then formed into compact rolls. The bags are typically joined to one another using perforations. Some bags, known as star-sealed bags are folded twice and then sealed across their bottom edges. This produces a bag with an extremely strong bottom.

When using roll mounted bags, it is critical that the bags are correctly loaded into the bag dispenser and that the bag roll cannot accidently leave the dispenser when a user attempts to pull a bag from the roll. Should this happen, the bag roll could end up on the floor of store, providing a potentially hazardous condition. It is even possible for a bag roll to fly out of the dispenser and strike a grocery patron when he attempts to pull a bag from the roll. Dispensers for roll mounted bags should ideally provide a means to insure that the bag roll will remain in the dispenser. Some examples of dispensers for roll mounted bags and related inventions include the following.

U.S. Pat. No. 5,556,019, issued to Morris, discloses a bag separator and dispenser used for separating and dispensing plastic bags linked together to form a roll structure. The bags are linked one to another by means of perforation lines and are dispensed from a wire frame structure with channels that support the core or axle of the rolled bags.

U.S. Pat. No. 6,279,806, issued to Simhaee is directed to a plastic bag dispenser in which the mounting plate is not perpendicular to the slots which receive the rolled bags on the axle.

U.S. Patent Application No. 2011/0073629, published for Tseng illustrates a plastic grocery bag dispenser with side panels and guide bar. The attachment means is connected to the bottom section which is attached to the plastic bag dispenser. The bottom section is at an angle to the roll mounting slots that exist in order to accommodate the roll of bags rotating about the axle and resting on the sides.

U.S. Pat. No. 5,261,585, issued to Simhaee is directed to a dispenser for plastic bags. The mounting section is at an angle with respect to slots that would accept the roll of plastic bags that rests upon and rotates about an axis while supported by the sides of the dispenser.

U.S. Pat. No. 6,230,953, issued to Simhaee is directed to a plastic bag dispenser which holds a continuous roll of bags connected by perforated separation lines. The roll of bags rests in curved grooves in the dispenser that cause the roll to abut and frictionally engage an interior surface of the dispenser, preventing free-wheeling of the roll. The curvature of the grooves causes the component of force which creates the frictional engagement to increase as the size of the roll decreases. The mounting means is supported by the pole that is positioned at an angle to the grooves which are mounted with respect to the vertical orientation of the dispenser. The roll of bags is mounted in the dispenser so that the roll frictionally engages an interior surface of the dispenser, thus allowing a bag to be removed and separated from the roll while the frictional force prevents the unwinding of the roll.

U.S. Pat. No. 6,488,222, issued to West et al. discloses a dispensing system that utilizes a roll of folded-gusseted bags in combination with a dispenser comprising: (i) a support member for attachment to a support surface; (ii) a pair of guide channels carried by the support member for rotatably supporting the roll of plastic bags for rotation of the roll on the core; (iii) a tongue spaced apart from and carried by the support member in a predetermined position corresponding to the predetermined position of the slit in the tear line.

U.S. Pat. No. 5,934,535, issued to Kannankeril et al. discloses a bag dispensing system providing plastic bags from a roll of bags where one end is attached to the top of the next bag by perforation lines with a slot therebetween. The roll of bags provides a core having an indexing member on at least one end. The dispenser comprising a wire frame formed into channels to support the core. The channels include a core retaining member for restraining the core in the channel. The dispenser includes at least one brake attached to a support member and disposed at an angle thereto to provide tension to the edges of the roll of bags as the core passes through the channel passageway as bags are removed from the roll.

It is an objective of the present invention to provide a bag dispensing system that provides large size film bags that are folded and provided as compact bag rolls. It is a further objective to provide a system that keeps the bag roll securely within the dispenser at all times. It is a still further objective of the invention to provide a dispensing system adaptable to a variety of different mountings. It is yet a further objective to provide such a system that provides a visual indication of the need to refill the dispenser. Finally, it is an objective of the present invention to provide a bag dispensing system that is durable, inexpensive, easy to keep clean and simple to use.

While some of the objectives of the present invention are disclosed in the prior art, none of the inventions found include all of the requirements identified.

SUMMARY OF THE INVENTION

The present invention addresses all of the deficiencies of prior art dispensers for roll mounted film bags and satisfies all of the objectives described above.

(1) An angled core slot dispenser providing the desired features may be constructed from the following components. An inclined platform is provided. The platform is sized and shaped to fit beneath a roll of film bags wound on a hollow central core. A core pin is provided. The core pin has first and second ends, is sized and shaped to fit slidably within the central core. First and second guide slots are provided. The slots are sized, shaped and located to fit slidably about the first and second ends of the core pin. At least one guide rail is provided. The guide rail is located between outer edges of at least one of the first and second guide slots and is sized and shaped to slidably engage the at least one notch in the core pin.

(2) In a variant of the invention, a bracket is provided. The bracket has fixtures for attachment to a lower portion of the inclined platform and is adapted to connect to at least one mounting system.

(3) In another variant, the core pin has at least one notch. The notch extends across one of the ends.

(4) In still another variant, at least one guide rail is provided. The guide rail is located between outer edges of at least one of the first and second guide slots and is sized and shaped to slidably engage the at least one notch in the core pin.

(5) In yet another variant, first and second side constraints are provided. The side constraints are located orthogonally to the inclined platform and spaced apart by at least a width of the roll of film bags.

(6) In another variant, a bag stream guide is provided. The bag stream guide is located orthogonally to the inclined platform at a front end of the dispenser and provides a pathway for a bag stream coming from the bag roll.

(7) In still another variant, a bag roll constraining barrier is provided. The barrier is located orthogonally to the inclined platform at a rear end of the dispenser and provides a guide for inserting the roll into the dispenser.

(8) In yet another variant, the first and second guide slots are located at an acute angle to the inclined platform.

(9) In a further variant, an upward facing snagging hook is provided. The snagging hook is located adjacent a lower end of the inclined platform.

(10) In still a further variant, the first and second side constraints are located behind the first and second guide slots.

(11) In yet a further variant, first and second front side constraints are provided. The front side constraints are located in front of the first and second guide slots.

(12) In another variant of the invention, at least one guide slot retainer is provided. The retainer is located at an upper end of at least one of the first and second guide slots. The retainer prevents unwanted removal of the roll of film bags from the dispenser.

(13) In still another variant, the bracket is attached to a mounting system attached to either of a vertical surface, a horizontal surface, or an angled surface.

(14) In yet another variant, a support member is provided. The support member extends between the bracket and a mounting surface.

(15) In a further variant, a security link is provided. The link flexibly attaches the core pin to the dispenser so as to prevent loss of the pin.

(16) In still a further variant, the security link is selected from the group includes chain, wire, string, cord or flexible plastic rod.

(17) In yet a further variant, an adapter for a bin is provided. The bin includes a support enclosure for a roll of film bags. The enclosure has a half round cylindrical wall, first and second vertical side walls. A supporting rim is provided. The rim is located orthogonally to front edges of the side walls and to upper and lower edges of the cylindrical wall. The rim has spaced apertures for mounting the bin to a surface. The surface has an opening sized and shaped to permit passage of outer surfaces of the walls but not the supporting rim. The vertical side walls have first and second integral channels. The channels provide an entry point and support for a rod. The rod is sized and shaped to support the roll of bags in the channels.

The adapter includes a fixture. The fixture includes a planar surface. The surface is sized and shaped to fit at least partially within the bin. At least one angled core slot bag dispenser for folded roll mounted film bags is provided. The dispenser includes a planar base. The base is sized and shaped to fit beneath a roll of the film bags and is mounted to the fixture. An inclined platform is provided. The platform is sized and shaped to fit beneath a roll of film bags wound on a hollow central core.

A core pin is provided. The core pin has first and second ends and is sized and shaped to fit slidably within the central core. First and second guide slots are provided. The slots are sized, shaped and disposed to fit slidably about the first and second ends of the core pin. A first axle is provided. The first axle is mounted orthogonally adjacent a first side edge of the fixture. A second axle is provided. The second axle is mounted orthogonally adjacent a second side edge of the fixture. The first axle is mounted coaxially with the second axle. First and second positioning wheels are provided. The positioning wheels are mounted to the first and second axles and located to slidably engage the first and second integral channels with a bottom surface of the fixture located adjacent a lower portion of the cylindrical wall of the enclosure.

(18) In another variant of the invention, the at least one angled core slot dispenser further includes at least one aperture penetrating the planar base for mounting the base to the fixture.

(19) In a further variant, the core pin further includes at least one notch, the notch extends across one of the ends.

(20) In still a further variant, the at least one angled core slot dispenser further includes at least one guide rail. The guide rail is located between outer edges of at least one of the first and second guide slots and is sized and shaped to slidably engage the at least one notch in the core pin.

(21) In yet a further variant, the at least one angled core slot dispenser further includes first and second side constraints. The side constraints are located orthogonally to the inclined platform and spaced apart by at least a width of the roll of film bags.

(22) In another variant of the invention, the at least one angled core slot dispenser further includes a bag stream guide. The bag stream guide is located orthogonally to the inclined platform at a front end of the dispenser and provides a pathway for a bag stream coming from the bag roll.

(23) In still another variant, the at least one angled core slot dispenser further includes a bag roll constraining barrier. The barrier is located orthogonally to the inclined platform at a rear end of the dispenser and providing a guide for inserting the roll into the dispenser.

(24) In yet another variant, the first and second guide slots of the at least one angled core slot dispenser are located at an acute angle to the inclined platform.

(25) In a further variant, the at least one angled core slot dispenser further includes an upward facing snagging hook. The snagging hook is located adjacent a lower end of the inclined platform.

(26) In still a further variant, the first and second side constraints of the at least one angled core slot dispenser are located behind the first and second guide slots.

(27) In yet a further variant, the at least one angled core slot dispenser further includes first and second front side constraints. The front side constraints are located in front of the first and second guide slots.

(28) In another variant of the invention, the at least one angled core slot dispenser further includes at least one guide slot retainer. The retainer is located at an upper end of at least one of the first and second guide slots. The retainer prevents unwanted removal of the roll of film bags from the dispenser.

(29) In still another variant, the at least one angled core slot dispenser further includes a security link. The link flexibly attaches the core pin to the dispenser so as to prevent loss of the pin.

(30) In a final variant, the security link is selected from the group includes chain, wire, string, cord or flexible plastic rod.

An appreciation of the other aims and objectives of the present invention and an understanding of it may be achieved by referring to the accompanying drawings and the detailed description of a preferred embodiment.

DESCRIPTION OF THE DRAWINGS

FIG. 4 is a side elevational view of the FIG. 1 embodiment illustrating the dispenser attached to a mounting system for attachment to a vertical surface;

FIG. 5 is a side elevational view of the FIG. 1 embodiment illustrating the dispenser attached to a mounting system for attachment to an angled vertical surface.

DETAILED DESCRIPTION OF THE PREFERRED EMBODIMENT (1) FIGS. 1-5 illustrate an angled core slot dispenser 10 providing the desired features that may be constructed from the following components. An inclined platform 14 is provided. The platform 14 is sized and shaped to fit beneath a roll of film bags 18 wound on a hollow central core 22. As illustrated in FIGS. 2 and 3, a core pin 38 is provided. The core pin 38 has first 42 and second 46 ends, is sized and shaped to fit slidably within the central core 22. As illustrated in FIGS. 1 and 2, first 54 and second 58 guide slots are provided. The slots 54, 58 are sized, shaped and located to fit slidably about the first 42 and second 46 ends of the core pin 38.

Figure 1:
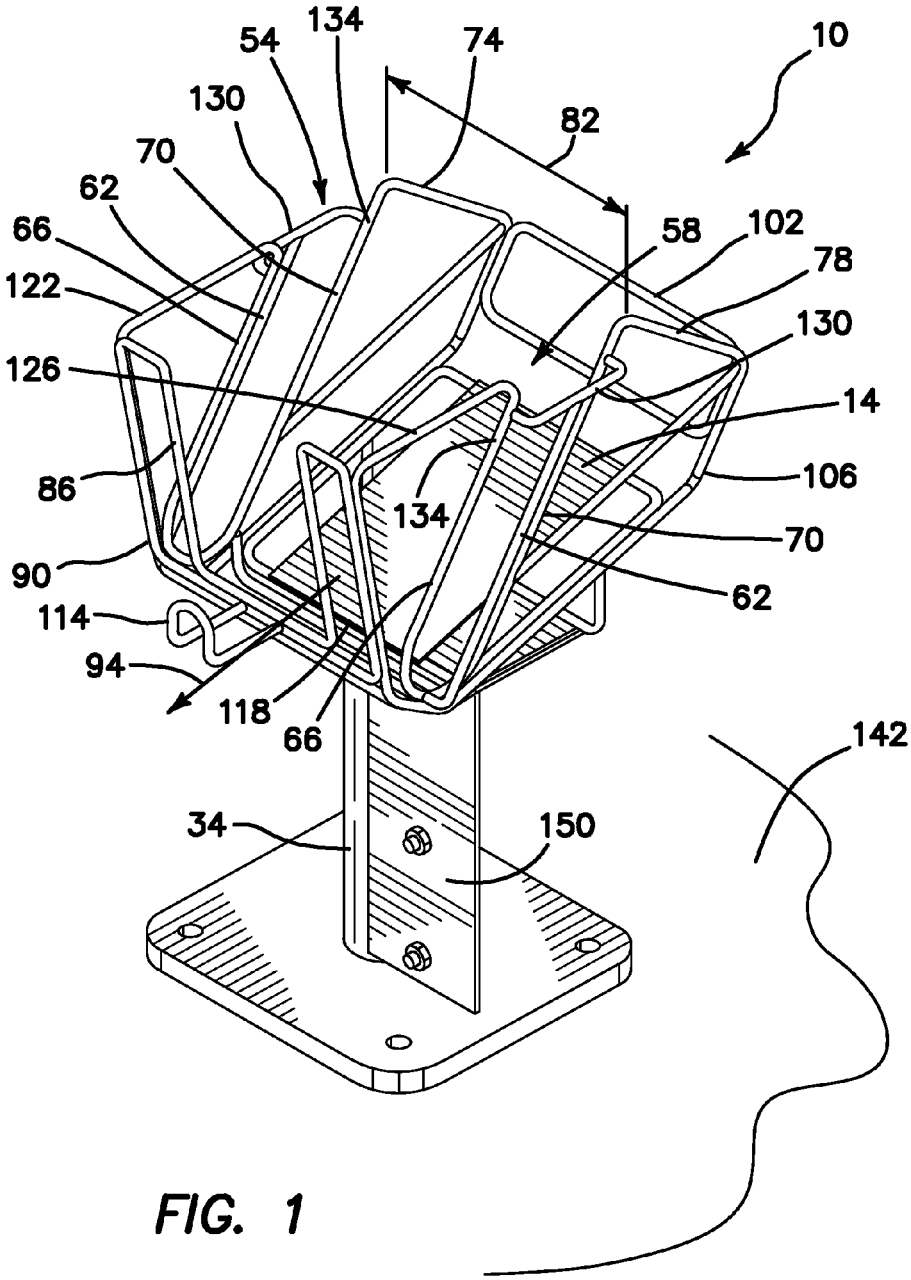
FIG. 1 is a perspective view of the preferred embodiment of the invention illustrating the dispenser attached to a mounting system for attachment to a horizontal surface.

(2) In a variant of the invention, a bracket 26 is provided. The bracket 26 has fixtures for attachment to a lower portion 30 of the inclined platform 14 and is adapted to connect to at least one mounting system 34.

(3) In another variant the core pin 38 has at least one notch 50. The notch 50 extends across one of the ends 42, 46.

(4) In still another variant, at least one guide rail 62 is provided. The guide rail 62 is located between outer edges 66, 70 of at least one of the first 54 and second 58 guide slots and is sized and shaped to slidably engage the at least one notch 50 in the core pin 38.

(5) In yet another variant of the invention, first 74 and second 78 side constraints are provided. The side constraints 74, 78 are located orthogonally to the inclined platform 14 and spaced apart by at least a width 82 of the roll of film bags 18.

(6) In another variant, a bag stream guide 86 is provided. The bag stream guide 86 is located orthogonally to the inclined platform 14 at a front end 90 of the dispenser 10 and provides a pathway 94 for a bag stream 98 coming from the bag roll 18.

(7) In still another variant, a bag roll constraining barrier 102 is provided. The barrier 102 is located orthogonally to the inclined platform 14 at a rear end 106 of the dispenser 10 and provides a guide for inserting the roll 18 into the dispenser 10.

(8) In yet another variant, the first 54 and second 58 guide slots are located at an acute angle 110 to the inclined platform 14.

(9) In a further variant, an upward facing snagging hook 114 is provided. The snagging hook 114 is located adjacent a lower end 118 of the inclined platform 14.

(10) In still a further variant, the first 74 and second 78 side constraints are located behind the first 54 and second 58 guide slots.

(11) In yet a further variant, first 122 and second 126 front side constraints are provided. The front side constraints 122, 126 are located in front of the first 54 and second 58 guide slots.

(12) In another variant of the invention, at least one guide slot retainer 130 is provided. The retainer 130 is located at an upper end 134 of at least one of the first 54 and second 58 guide slots. The retainer 130 prevents unwanted removal of the roll of film bags 18 from the dispenser 10.

(13) In still another variant, as illustrated in FIGS. 1, 4 and 5, the bracket 26 is attached to a mounting system 34 attached to either of a vertical surface 138, a horizontal surface 142, or an angled surface 146.

(14) In yet another variant, a support member 150 is provided. The support member 150 extends between the bracket 26 and a mounting surface 138, 142, 146.

Figure 3:
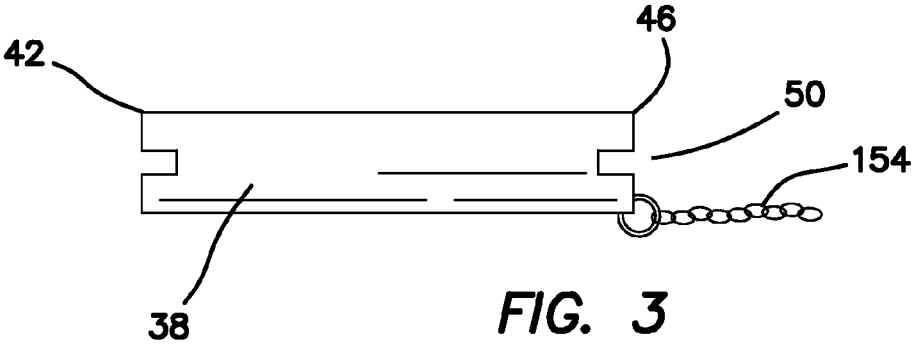
FIG. 3 is a side elevational view of the core pin on which the bag roll of the FIG. 2 embodiment rotates.
Figure 6:
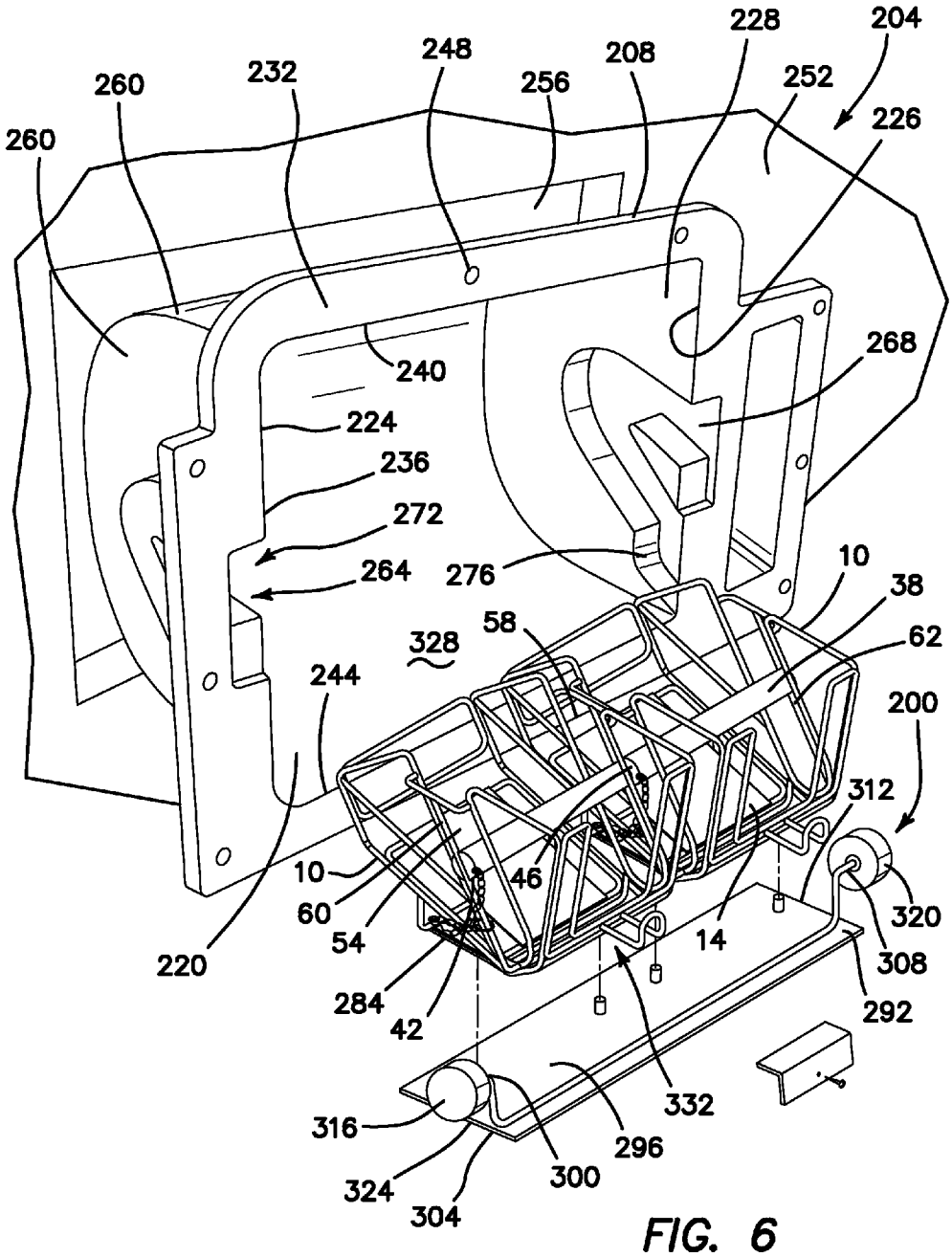
FIG. 6 is a perspective exploded view of an adapter for a bin with two of the FIG. 1 dispensers in the bin.
Figure 7:
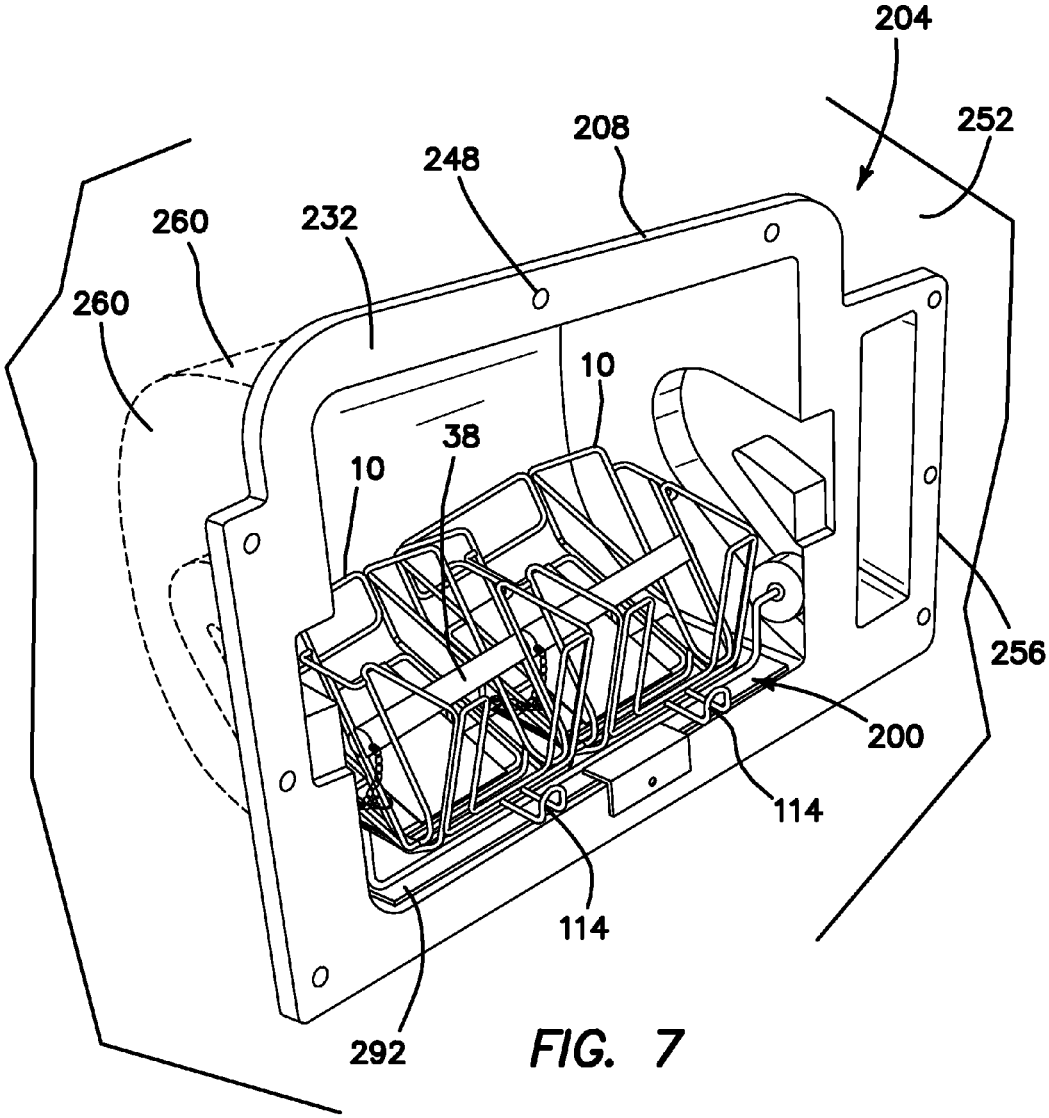
FIG. 7 is an assembled perspective view of the FIG. 6 embodiment.
Figure 8A:
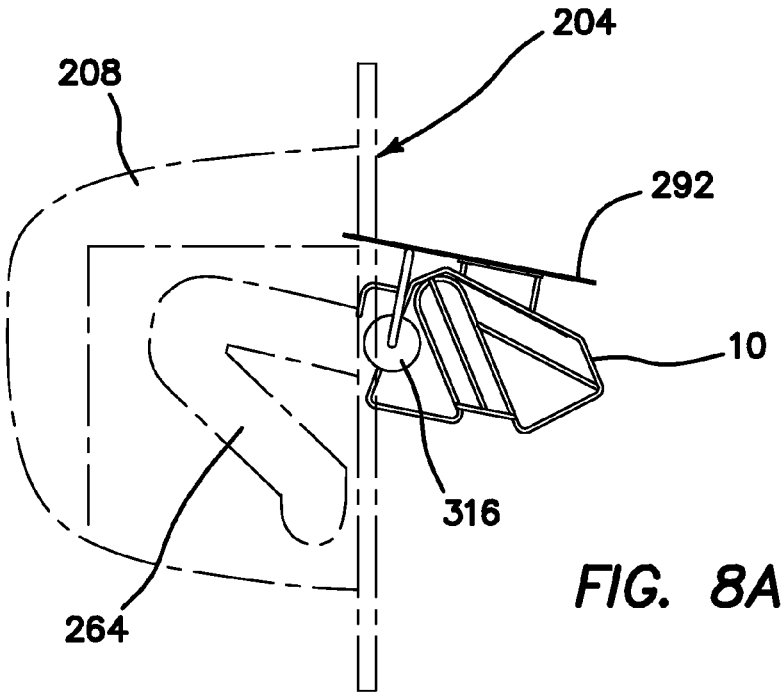
FIGS. 8A-8D are side elevational views of the installation of the FIG. 6 embodiment being installed into the bin.
Figure 8B:
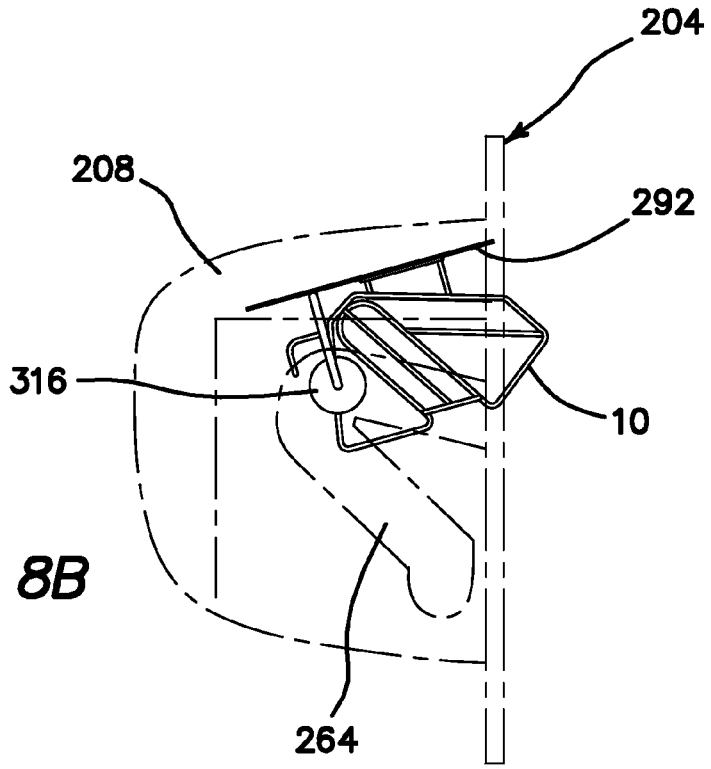
Figure 8C:
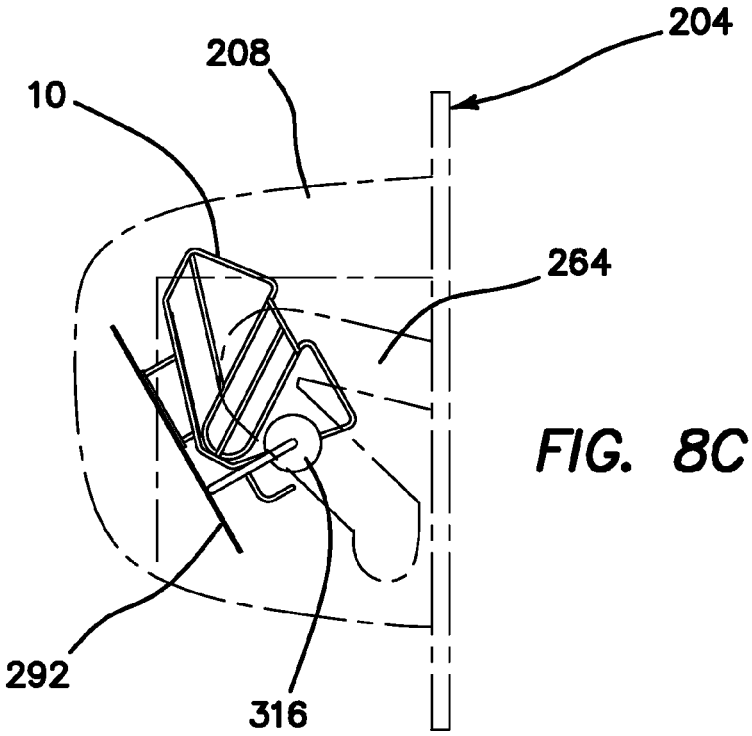
Figure 8D:
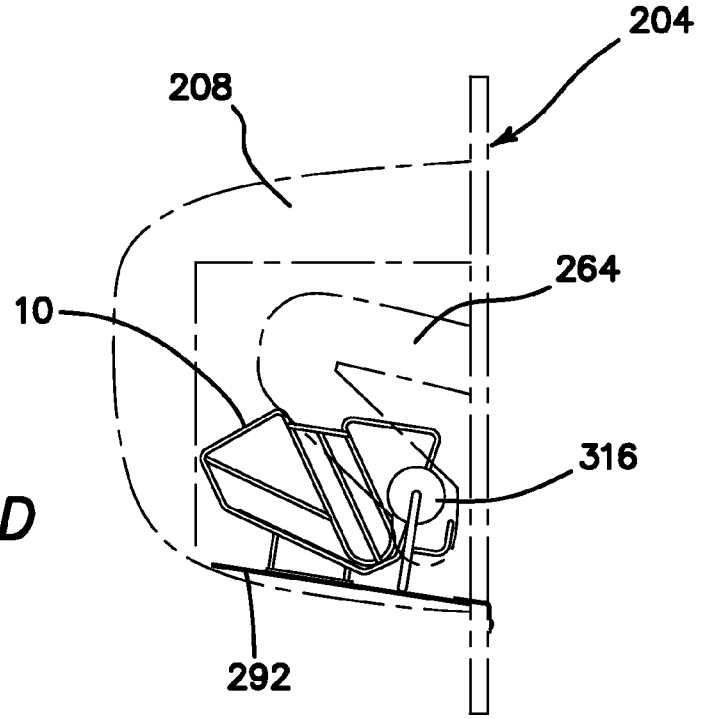

(15) In a further variant, as illustrated in FIGS. 3, 6 and 7, a security link 154 is provided. The link 154 flexibly attaches the core pin 38 to the dispenser 10 so as to prevent loss of the pin 38.

(16) In still a further variant, the security link 154 is selected from the group includes chain (158), wire (not shown), string (not shown), cord (not shown) or flexible plastic rod (not shown).

(17) In yet a further variant, as illustrated in FIGS. 6, 7 and 8A-8D, an adapter 200 for a bin 204 is provided. The bin 204 includes a support enclosure 208 for a roll of film bags (not shown). The enclosure 208 has a half round cylindrical wall 220, first 224 and second 228 vertical side walls. A supporting rim 232 is provided. The rim 232 is located orthogonally to front edges 236 of the side walls 224, 228 and to upper 240 and lower 244 edges of the cylindrical wall 220. The rim 232 has spaced apertures 248 for mounting the bin 204 to a surface 252. The surface 252 has an opening 256 sized and shaped to permit passage of outer surfaces 260 of the walls 224, 228, and 220 but not the supporting rim 232. The vertical side walls 224, 228 have first 264 and second 268 integral channels. The channels 264, 268 provide an entry point 272 and support 276 for a rod (not shown). The rod is sized and shaped to support the roll of bags in the channels 264, 268.

The adapter 200 includes a fixture 292. The fixture 292 includes a planar surface 296. The surface 296 is sized and shaped to fit at least partially within the bin 204. At least one angled core slot bag dispenser 10 for folded roll mounted film bags 18 is provided. The dispenser 10 has a planar base 284. The base 284 is sized and shaped to fit beneath a roll of the film bags 18 and is mounted to the fixture 292. An inclined platform 14 is provided. The platform 14 is sized and shaped to fit beneath a roll of film bags 18 wound on a hollow central core 22.

Figure 2:
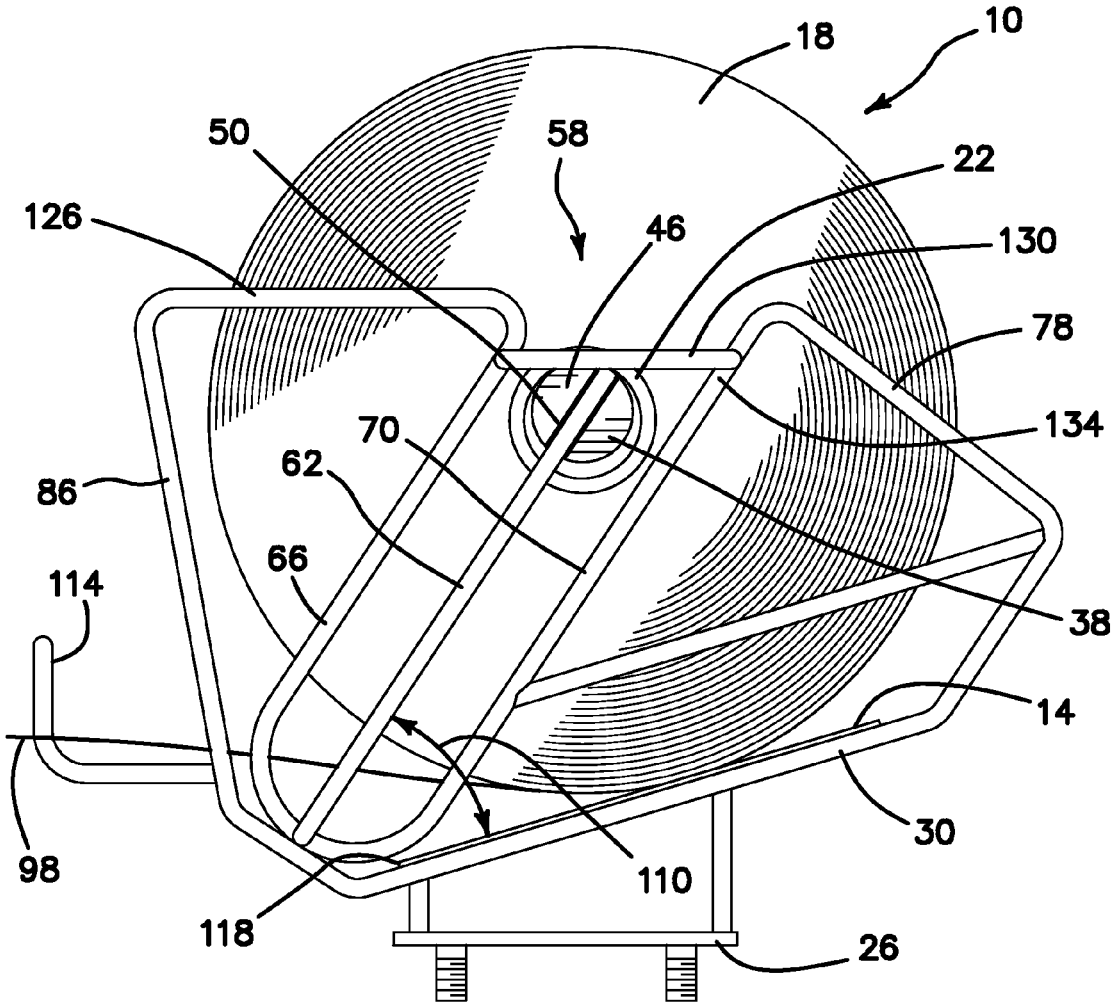
FIG. 2 is a side elevational view of the FIG. 1 embodiment illustrating a bag roll in place in the dispenser.

As illustrated in FIGS. 2 and 3, a core pin 38 is provided. The core pin 38 has first 42 and second 46 ends, is sized and shaped to fit slidably within the central core 22. As illustrated in FIGS. 1 and 2, first 54 and second 58 guide slots are provided. The slots 54, 58 are sized, shaped and located to fit slidably about the first 42 and second 46 ends of the core pin 38. A first axle 300 is provided. The first axle 300 is mounted orthogonally adjacent a first side edge 304 of the fixture 292. A second axle 308 is provided. The second axle 308 is mounted orthogonally adjacent a second side edge 312 of the fixture 292. The first axle 300 is mounted coaxially with the second axle 308. First 316 and second 320 positioning wheels are provided. The positioning wheels 316, 320 are mounted to the first 300 and second 308 axles and located to slidably engage the first 264 and second 268 integral channels with a bottom surface 324 of the fixture 292 located adjacent a lower portion 328 of the cylindrical wall 220 of the enclosure 208.

(18) In another variant of the invention, the at least one angled core slot dispenser 10 further includes at least one aperture 332 penetrating the planar base 284 for mounting the base 284 to the fixture 292.

(19) In a further variant, as illustrated in FIGS. 2, 3, 6 and 7, the core pin 38 further includes at least one notch 50, the notch 50 extends across one of the ends 42, 46.

(20) In still a further variant, as illustrated in FIGS. 1, 2, 6 and 7, the at least one angled core slot dispenser 10 further includes at least one guide rail 62 is provided. The guide rail 62 is located between outer edges 66, 70 of at least one of the first 54 and second 58 guide slots and is sized and shaped to slidably engage the at least one notch 50 in the core pin 38.

(21) In yet a further variant, the at least one angled core slot dispenser 10 further includes first 74 and second 78 side constraints. The side constraints 74, 78 are located orthogonally to the inclined platform 14 and spaced apart by at least a width 82 of the roll of film bags 18.

(22) In another variant of the invention, the at least one angled core slot dispenser 10 further includes a bag stream guide 86. The bag stream guide 86 is located orthogonally to the inclined platform 14 at a front end 90 of the dispenser 10 and provides a pathway 94 for a bag stream 98 coming from the bag roll 18.

(23) In still another variant, the at least one angled core slot dispenser 10 further includes a bag roll constraining barrier 102. The barrier 102 is located orthogonally to the inclined platform 14 at a rear end 106 of the dispenser 10 and provides a guide for inserting the roll 18 into the dispenser 10.

(24) In yet another variant, the first 54 and second 58 guide slots of the at least one angled core slot dispenser 10 are located at an acute angle 110 to the inclined platform 14.

(25) In a further variant, the at least one angled core slot dispenser 10 further includes an upward facing snagging hook 114. The snagging hook 114 is located adjacent a lower end 118 of the inclined platform 14.

(26) In still a further variant, the first 74 and second 78 side constraints are located behind the first 54 and second 58 guide slots.

(27) In yet a further variant, the at least one angled core slot dispenser 10 further includes first 122 and second 126 front side constraints. The front side constraints 122, 126 are located in front of the first 54 and second 58 guide slots.

(28) In another variant of the invention, the at least one angled core slot dispenser 10 further includes at least one guide slot retainer 130. The retainer 130 is located at an upper end 134 of at least one of the first 54 and second 58 guide slots. The retainer 130 prevents unwanted removal of the roll of film bags 18 from the dispenser 10.

(29) In still another variant, as illustrated in FIGS. 3, 6 and 7, the at least one angled core slot dispenser 10 further includes a security link 154. The link 154 flexibly attaches the core pin 38 to the dispenser 10 so as to prevent loss of the pin 38.

(30) In a final variant, the security link 154 is selected from the group includes chain (158), wire (not shown), string (not shown), cord (not shown) or flexible plastic rod (not shown).

The angled core slot dispenser 10 and adapter for a bin 200 have been described with reference to particular embodiments. Other modifications and enhancements can be made without departing from the spirit and scope of the claims that follow.

The invention claimed is:

1. An angled core slot dispenser system comprising:

a roll of film bags wound on a hollow central core;

an inclined platform, said platform being sized and shaped to fit frictionally beneath a roll of film bags wound on a hollow central core;

a core pin, said core pin having first and second ends, being sized and shaped to fit slidably within said central core;

said core pin having at least one central notch, said notch extending across a diameter of one of said ends;

first and second guide slots, said slots being sized, shaped and disposed to permit said first and second ends of said core pin to fit slidably within said first and second guide slots; and at least one guide rail, said at least one guide rail being disposed between outer edges and extending along the substantial length of at least one of said first and second guide slots;

said at least one notch of said core pin being sized and shaped to slidably engage said at least one guide rail to constrain the rotational movement of the core pin along the substantial length of said at least one guide rail within said at least one of said first and second guide slots;

wherein the core pin slides within the first and second guide slots and the roll of film bags maintains a frictional engagement with the platform as the bags are dispensed.

2. The angled core slot dispenser system, as described in claim 1, further comprising a bracket, said bracket having fixtures for attachment to a lower portion of said inclined platform and being adapted to connect to at least one mounting system.

3. The angled core slot dispenser system, as described in claim 1, further comprising first and second side constraints, said side constraints being disposed orthogonally to said inclined platform and spaced apart by at least a width of said roll of film bags.

4. The angled core slot dispenser system, as described in claim 1, further comprising a bag stream guide, said bag stream guide being disposed at an angle to said inclined platform at a front end of said dispenser and providing a pathway for a bag stream coming from said bag roll.

5. The angled core slot dispenser system, as described in claim 1, further comprising a bag roll constraining barrier, said barrier being disposed at an obtuse angle to said inclined platform at a rear end of said dispenser and providing a guide for inserting said roll into said dispenser.

6. The angled core slot dispenser system, as described in claim 1, wherein said first and second guide slots are disposed at an acute angle to said inclined platform.

7. The angled core slot dispenser system, as described in claim 1, further comprising an upward facing snagging hook, said snagging hook being disposed adjacent a lower end of said inclined platform.

8. The angled core slot dispenser system, as described in claim 3, wherein said first and second side constraints are disposed behind said first and second guide slots.

9. The angled core slot dispenser system, as described in claim 1, further comprising first and second front side constraints, said front side constraints being disposed in front of said first and second guide slots.

10. The angled core slot dispenser system, as described in claim 1, further comprising at least one guide slot retainer, said retainer being disposed at an upper end of at least one of said first and second guide slots, said retainer preventing unwanted removal of said roll of film bags from said dispenser.

11. The angled core slot dispenser system, as described in claim 2, wherein said bracket is attached to a mounting system attached to either of a vertical surface, a horizontal surface, or an angled surface.

12. The angled core slot dispenser system, as described in claim 2, further comprising a support member, said support member extending between said bracket and a mounting surface.

13. The angled core slot dispenser system, as described in claim 1, further comprising a security link, said link flexibly attaching said core pin to said dispenser so as to prevent loss of said pin.

14. The angled core slot dispenser system, as described in claim 13, wherein said security link is selected from the group comprising:

chain, wire, string, cord or flexible plastic rod.

15. An adapter for a bin, the bin having:

a support enclosure for a roll of film bags, the enclosure having a half round cylindrical wall, first and second vertical side walls;

a supporting rim, the rim disposed orthogonally to front edges of the side walls and upper and lower edges of the cylindrical wall and having spaced apertures for mounting the bin to a surface;

the surface having an opening sized and shaped to permit passage of outer surfaces of the walls but not the supporting rim;

the vertical side walls having first and second integral channels, the channels providing an entry point and support for either of a rod, the rod being sized and shaped to support the roll of bags in the channels and an adapter for the bin;

said adapter comprising:

a fixture, said fixture comprising a planar upper surface and a bottom surface, said surfaces being sized and shaped to fit at least partially within the bin;

at least one angled core slot bag dispenser system for folded roll mounted film bags, said dispenser system comprising:

a roll of film bags wound on a hollow central core;

a planar base, said base being sized and shaped to fit beneath said roll of said film bags and being mounted to said fixture;

an inclined platform, said platform being sized and shaped to fit frictionally beneath said roll of film bags wound on a hollow central core;

a core pin, said core pin having first and second ends, being sized and shaped to fit slidably within said central core;

said core pin having at least one central notch, said notch extending across a diameter of one of said ends;

first and second guide slots, said slots being sized, shaped and disposed to permit said first and second ends of said core pin to fit slidably within said first and second guide slots;

at least one guide rail, said at least one guide rail being disposed between outer edges and extending along the substantial length of at least one of said first and second guide slots;

said at least one notch of said core pin being sized and shaped to slidably engage said at least one guide rail to constrain the rotational movement of the core pin along the substantial length of said at least one guide rail within said at least one of said first and second guide slots;

wherein the core pin slides within the first and second guide slots and the roll of film bags maintains a frictional engagement with the platform as the bags are dispensed;

a first axle, said first axle being mounted orthogonally adjacent a first side edge of said fixture;

a second axle, said second axle being mounted orthogonally adjacent a second side edge of said fixture;

said first axle being mounted coaxially with said second axle;

first and second positioning wheels, said positioning wheels being mounted to said first and second axles and disposed to slidably engage said first and second integral channels with said bottom surface of said fixture disposed adjacent a lower portion of said cylindrical wall of said enclosure.

16. The adapter for a bin, as described in claim 15, wherein said at least one angled core slot dispenser system further comprises at least one aperture penetrating said planar base for mounting said base to said fixture.

17. The adapter for a bin, as described in claim 15, wherein said at least one angled core slot dispenser system further comprises first and second side constraints, said side constraints being disposed orthogonally to said inclined platform and spaced apart by at least a width of said roll of film bags.

18. The adapter for a bin, as described in claim 15, wherein said at least one angled core slot dispenser system further comprises a bag stream guide, said bag stream guide being disposed at an angle to said inclined platform at a front end of said dispenser and providing a pathway for a bag stream coming from said bag roll.

19. The adapter for a bin, as described in claim 15, wherein said at least one angled core slot dispenser system further comprises a bag roll constraining barrier, said barrier being disposed at an obtuse angle to said inclined platform at a rear end of said dispenser and providing a guide for inserting said roll into said dispenser.

20. The adapter for a bin, as described in claim 15, wherein said first and second guide slots of said at least one angled core slot dispenser system are disposed at an acute angle to said inclined platform.

21. The adapter for a bin, as described in claim 15, wherein said at least one angled core slot dispenser system further comprises an upward facing snagging hook, said snagging hook being disposed adjacent a lower end of said inclined platform.

22. The adapter for a bin, as described in claim 17, wherein said first and second side constraints of said at least one angled core slot dispenser system are disposed behind said first and second guide slots.

23. The adapter for a bin, as described in claim 15, wherein said at least one angled core slot dispenser system further comprises first and second front side constraints, said front side constraints being disposed in front of said first and second guide slots.

24. The adapter for a bin, as described in claim 15, wherein said at least one angled core slot dispenser system further comprises at least one guide slot retainer, said retainer being disposed at an upper end of at least one of said first and second guide slots, said retainer preventing unwanted removal of said roll of film bags from said dispenser.

25. The adapter for a bin, as described in claim 15, wherein said at least one angled core slot dispenser system further comprises a security link, said link flexibly attaching said core pin to said dispenser so as to prevent loss of said pin.

26. The adapter for a bin, as described in claim 25, wherein said security link is selected from the group comprising:

chain, wire, string, cord or flexible plastic rod.

* * * * *